United States Patent [19]

Haugsjaa et al.

[11] 3,943,401

[45] Mar. 9, 1976

[54] ELECTRODELESS LIGHT SOURCE HAVING A LAMP HOLDING FIXTURE WHICH HAS A SEPARATE CHARACTERISTIC IMPEDANCE FOR THE LAMP STARTING AND OPERATING MODE

[75] Inventors: Paul Osborne Haugsjaa, Acton; Robert James Regan, Needham; William Henry McNeill, Carlisle, all of Mass.

[73] Assignee: GTE Laboratories Incorporated, Waltham, Mass.

[22] Filed: Apr. 21, 1975

[21] Appl. No.: 570,111

[52] U.S. Cl. ..... 315/39; 315/248

[51] Int. Cl.[2] ..... H01J 61/56

[58] Field of Search ..... 315/39, 248, 267, 344; 313/182

[56] References Cited

UNITED STATES PATENTS 3,787,705 1/1974 Bolin et al. ..... 315/248

*Primary Examiner*—R. V. Rolinec
*Assistant Examiner*—Darwin R. Hostetter
*Attorney, Agent, or Firm*—Irving M. Kriegsman; Leslie J. Hart

[57] ABSTRACT

A lamp holding fixture for exciting an electrodeless lamp by high frequency power has a switchable characteristic impedance for impedance matching the lamp to the power source during both the starting and operating modes. The fixture has an inner conductor and two outer conductors of different dimensions in cross section. During the starting mode the inner conductor and the larger diameter outer conductor form the power coupling conductors for the fixture thereby providing a high characteristic impedance for matching the lamp impedance to the source output impedance. After starting, the smaller diameter outer conductor may be moved along its longitudinal axis until it contacts the power coupling end of the larger diameter outer conductor so that the inner conductor and the smaller diameter outer conductors form the power coupling conductors during the operating mode.

10 Claims, 4 Drawing Figures

ELECTRODELESS LIGHT SOURCE HAVING A LAMP HOLDING FIXTURE WHICH HAS A SEPARATE CHARACTERISTIC IMPEDANCE FOR THE LAMP STARTING AND OPERATING MODE

BACKGROUND OF THE INVENTION

The present invention relates to electrodeless light sources and, more particularly, to such sources which are excited by high frequency power, such as in the range of 100 MHz to 300 GHz.

There have been, historically, three basic methods of exciting discharges without electrodes. The first method uses the discharge as a lossy part of either the capacitance or inductance of a "tank" circuit. This method is used to advantage only at frequencies where the dimensions of the lamp are much smaller than the wavelength of excitation. Also, in this method, there are power losses due to radiation and shifts in frequency upon start-up. A second method of exciting electrodeless lamps with microwave power is to place the lamp in the path of radiation from a directional antenna. However, since free propagation of microwave power occurs, there is an inherent inefficiency and some of the power is scattered, thereby endangering persons in the area.

A third method uses a resonant cavity which contains the lamp, a frequency tuning stub and a device for matching the lamp-cavity impedance to that of the source and transmission line. Examples of devices according to this method may be found in "Microwave Discharge Cavities Operating at 2450 MHz" by F. C. Fehsenfield et al., Review of Scientific Instruments, Volume 36, Number 3 (March, 1965). This publication describes several types of tunable cavities. In one type, cavity 5, the discharge cavity transfers power from the source to the lamp, and the resonant structure of the cavity increases the electric field in the gas of the lamp. The presence of a discharge in the resonator changes the resonant frequency and also changes the loaded Q factor. Therefore, it is necessary to provide both tuning (frequency) and matching (impedance) adjustments to obtain efficient operation over a wide range of discharge conditions. The tuning stub is first adjusted for a minimum reflected power with the minimum probe penetration. Next, the probe (impedance) is adjusted. Since these two operations are not independent, successive readjustments are required to achieve optimum efficiency.

All of these tunable cavities have features which make them less than ideally suited for use in an electrodeless light source. To make cavity type systems useful economically, the cavity must be small enough so that it would be feasible to use such systems in place of the conventional electrode containing lamp. Resonant cavities are too large and must be larger if lower microwave frequencies are used. One resonant cavity for 2450 MHz operation has four inches as its greatest dimension; the size would be even larger for operation at 915 MHz which is a standard microwave frequency for consumer use, such as with microwave ovens. Operation at this lower frequency is also advantageous from the view that the greater the frequency the more expensive the microwave power source becomes. The known tunable cavity has a less than optimum shape because the lamp is substantially enclosed by the resonant cavity housing, thereby impeding the transmission of light.

SUMMARY OF THE INVENTION

It is an object of the present invention to provide an electrodeless light source having an improved lamp holding fixture.

It is another object to provide a lamp fixture with a switchable characteristic impedance so that the fixture has one impedance at the starting mode and another impedance during the operation mode.

It is still another object to provide an electrodeless light source with no starting assist devices external to the termination fixture for the lamp.

According to the present invention, there is provided a termination fixture for use in an electrodeless light source which is excited by power at a high frequency. More specifically, the fixture includes an inner conductor, a first outer conductor disposed around the inner conductor and a second outer conductor disposed around the first outer conductor. The inner conductor and the second outer conductor have dimensions in cross section such that the fixture has a characteristic impedance which substantially matches the lamp impedance at starting to the output impedance of the power source. During starting only these two conductors of the three couple power to the lamp. A device is provided for causing only the inner conductor and the first outer conductor to couple power to the lamp during the operating mode; these two conductors having dimensions in cross section and length to produce a characteristic impedance which matches the real part of the lamp operating impedance to the source output impedance.

In a preferred embodiment, the first outer conductor may be moved along its longitudinal axis during the operate mode so that it comes into contact with the power source coupled end of the second outer conductor. Also, the conductors are circular in cross section and concentric with respect to each other. The conductor lengths are substantially a quarter wavelength long. Various arrangements are described for moving the first outer conductor with devices external to the walls of the termination fixture. Preferably, the arrangement is a non-conducting member attached to the first outer conductor and extending through a longitudinal slot formed in the second outer conductor.

DESCRIPTION OF PREFERRED EMBODIMENTS

Figure 1:
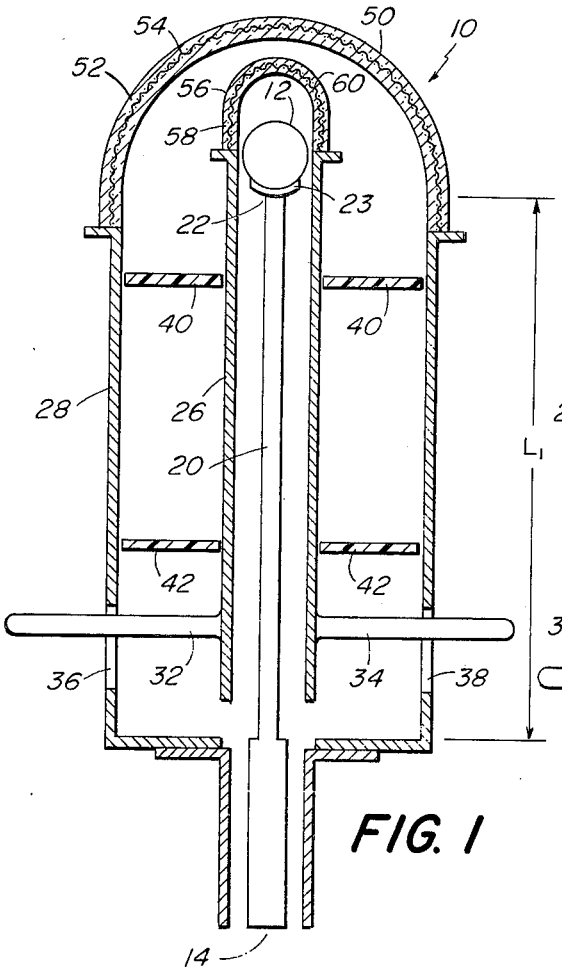
FIG. 1 is a sectional view of a lamp holding fixture according to the invention wherein the conductors are arranged for use in the lamp starting mode.
Figure 2:
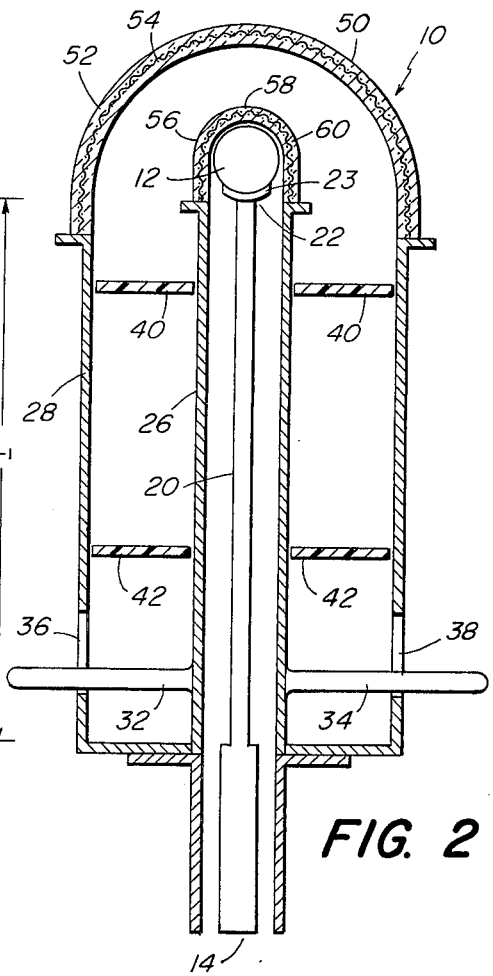
FIG. 2 is a view of the embodiment of FIG. 1 with the conductors arranged for use in the lamp running or operating mode.

In an exemplary embodiment of the present invention, as illustrated in FIGS. 1 and 2, there is provided a termination fixture, represented generally by the reference numeral 10, for use in a high frequency powered electrodeless light source. The light source includes an electrodeless lamp 12 which has an envelope made of a light transmitting material and a fill material enclosed by the envelope, the fill material emitting light upon breakdown and excitation. A source of power at a high frequency (not shown) couples power to the fixture by way of the input connector 14. As used herein, the phrase "high frequency" is intended to include frequencies in the range from 100 MHz to 300 GHz. Preferably, the frequency is in the ISM band (i.e., Industrial Scientific and Medical Band) which ranges from 902 MHz to 928 MHz. In a preferred embodiment, the frequency is 915 MHz. One of many commercially available power sources which may be used is an Airborne Instruments Laboratory power source, type 25. One suitable electrodeless lamp 12 which may be used includes a quartz, spherical envelope (15 mm ID) and a fill material comprising 9.1 mg. of mercury and 10 torr of argon. This lamp thus includes a volatile fill material which produces light upon breakdown and excitation. Several known fill materials may be used for the lamp 12.

The fixture 10 has an inner conductor 20 having a first end which is adapted to be coupled to the source of high frequency power and a second end 22 adapted to be in field coupling relationship to the lamp 12. Preferably, the inner conductor includes a lamp holding element 23. A first outer conductor 26 is disposed around the inner conductor 20. Also, a second outer conductor 28 is disposed around the first outer conductor 26, the second conductor 28 having a first end adapted to be coupled to the source of high frequency power. The inner conductor 20 and the second outer conductor 28 have dimensions in cross section which are selected to produce a characteristic impedance which is effective to initiate breakdown in the lamp.

In accordance with the present invention, means are provided for moving the first outer conductor 26 along its longitudinal axis to cause the conductor 26 to contact the second outer conductor 28 at the source coupled end of the fixture 10. Also, the inner conductor 20 and the first outer conductor 26 have dimensions in cross section selected to produce a characteristic impedance which matches the real part of the lamp impedance during the operative mode to the output impedance of the source.

In FIGS. 1 and 2 the contacting means includes a pair of non-conducting members 32 and 34 which are attached to the first outer conductor 26 and which extend through a pair of longitudinal slots 36 and 38 formed in the second outer conductor 28. In operation, FIG. 1 illustrates the position of the first outer conductor 26 during the starting mode. FIG. 2 illustrates the position of the first outer conductor 26 for use in the operating mode.

Preferably, the conductors 20, 26 and 28 are circular in cross section and concentric with respect to each other. The inner conductor 20 is formed with a length L1 as illustrated in FIG. 1; for reasons to be described subsequently, this length L1 is preferably equal to one-quarter wavelength. A pair of non-conducting support rings 40 and 42 are located between the first and second outer conductors 26 and 28 respectively for maintaining the conductors concentric with respect to the inner conductor 20. Also, a dome-shaped member 50 is located over the end of the second outer conductor 28, the member 50 being made of a light transmitting material 52, and including therein a metallic mesh 54. Similarly, a second dome-shaped member 56 is located over the end 22 of the first inner conductor 20, the member 56 being made of a light-transmitting material 58 and including a metallic mesh 60 within the light-transmitting material 58.

Figure 3:
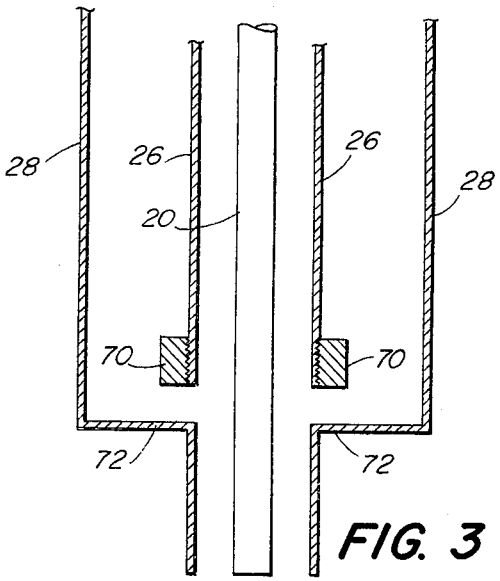
FIG. 3 is a partial sectional view of an alternative embodiment of a means for switching the fixture conductors, the fixture being shown for use in the lamp starting mode.
Figure 4:
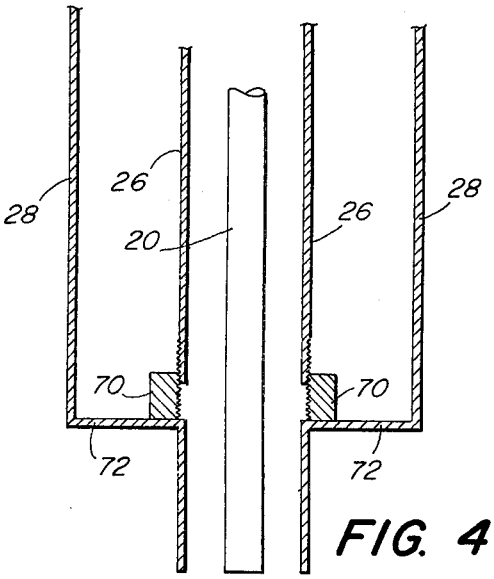
FIG. 4 is a view of the embodiment of FIG. 3 with the conductors being arranged for use in the lamp running or operating mode.

Referring now to FIGS. 3 and 4, the means for moving the first outer conductor 26 includes a conductive sleeve 70 threaded on its inner diameter disposed around the smaller diameter outer conductor 26 which is threaded to accept the sleeve 70. This sleeve is adapted to rotate in a manner such that the sleeve 70 may come into contact with an end member 72. The sleeve 70 is conductive so that when it contacts the element 72 as shown in FIG. 4, the power coupling conductors of the fixture become the inner conductor 20 and the first outer conductor 26. One suitable manner of rotating the sleeve 70 is to provide a gear assembly which may be adjusted externally to the fixture 10.

The following describes the basic operation of the improved lamp holding fixture of the present invention. The basic idea is to provide a method by which the fixture may be switched from one characteristic impedance to another without disturbing the position or the continuity of the center conductor 20 or the overall symmetry of the termination fixture. When incorporated as the impedance matching section in a termination fixture, this provides sufficient impedance matching to start an electrodeless lamp and when switched to another position will provide a nearly perfect match to the lamp operating condition. The advantage of this system is that the impedance matching is physically closer to the lamp thereby reducing power losses associated with standing waves in the line between the lamp during the operating state and any external matching network. In addition, this invention allows an impedance transformation selection for the starting condition which is independent of operating condition impedance matching considerations. This results in the capability of producing higher voltages at the lamp for easier starting.

The characteristic impedance of the termination fixture can be determined using the following equation:

$$Z = \frac{138}{(\epsilon_r/\mu_r)^{1/2}} \log \frac{b}{a}$$

Where $\epsilon_r$ = dielectric constant of the medium between the conductors $\mu_r$ = permeability of the medium between the conductors b = inner diameter of the outer conductor a = diameter of the inner conductor By changing the value of (b) without changing the value of (a) in the termination fixture an altered characteristic impedance results. As illustrated in FIGS. 1 and 2, the characteristic impedance for the FIG. 1 embodiment is higher than the characteristic impedance for the embodiment shown in FIG. 2. It should be noted that when the low impedance outer conductor is isolated from the high impedance outer conductor it will have no effect on the system. When an isolated thin cylindrical conducting surface with a circular cross section is positioned coaxially between the inner conductor and the outer conductor of a circular-type coaxial line it will have a negligible effect on the field configuration in the line. When the first outer conductor 26 is in use, the high impedance outer conductor or the second outer conductor 28 is out of the circuit.

The following criteria are followed for designing the geometry of the termination fixture 10. First, the output impedance of the source is determined; in the preferred embodiment the output impedance of the source was 50 ohms. Then the impedance of the lamp prior to starting and during the operating mode are determined. Conventionally known techniques such as measurements of the magnitude and position of voltage standing waves provide these impedance values. Knowing these impedance values, one may determine what the characteristic impedance of the fixture 10 must be to match the lamp impedance to the output impedance of the source. If the length of the inner conductor 20 is substantially equal to one-quarter wavelength of the applied high frequency power and the effective impedance of the lamp $Z_L$ is real, the problem becomes simplified in that the equation for determining the characteristic impedance of the fixture becomes as follows:

$$Z_0 = (Z_s \cdot Z_L)^{1/2}$$

Where $Z_s$ equals the output impedance of the source

In its broadest aspect, the present invention contemplates the idea of altering the physical geometry of the conductors comprising the termination fixture to produce one of two characteristic impedances for the lamp for the termination fixture.

The embodiments of the present invention are intended to be merely exemplary and those skilled in the art shall be able to make numerous variations and modifications to them without departing from the spirit of the present invention. All such variations and modifications are intended to be within the scope of the present invention as defined in the appended claims.

We claim:

1. In a light source having an electrodeless lamp with an envelope made of a light transmitting substance and enclosing a volatile fill material which emits light upon breakdown and excitation a termination fixture for coupling high frequency power to the lamp including:

a. an inner conductor having a first end adapted to be coupled to a source of high frequency power and a second end adapted to be in field coupling relation to the lamp, b. a first outer conductor disposed around and insulated from the inner conductor, c. a second outer conductor disposed around the first outer conductor, the second conductor having a first end adapted to be coupled to the source of high frequency power, the inner conductor and the second outer conductor having dimensions in cross section which are selected to produce a first characteristic impedance which is effective to initiate breakdown in the lamp, and d. means for moving the first outer conductor along its longitudinal axis to cause the first outer conductor to contact the second outer conductor at the source coupled end, the inner conductor and the first outer conductor having dimensions in cross section selected to produce a characteristic impedance which matches the lamp impedance during operation to the output impedance of the source.

2. The fixture according to claim 1, wherein the conductors are circular in cross section and concentric with respect to each other.

3. The fixture according to claim 2, wherein the contacting means includes a non-conducting member attached to the first outer conductor and extending through a longitudinal slot formed in the second outer conductor.

4. The fixture according to claim 1, wherein the contacting means includes an internally threaded sleeve disposed around an externally threaded end of the first outer conductor, the sleeve being adapted to rotate such that the sleeve comes into contact with the source end of the second conductor.

5. The fixture according to claim 2 further including non-conducting support rings located between the first and second outer conductors for maintaining the conductors concentric with respect to the inner conductor.

6. The fixture according to claim 2 further including a first dome-shaped member located over the end of the second outer conductor, the first member being made of a light transmitting material and including a metallic mesh within the material.

7. The fixture according to claim 6 further including a second dome-shaped member located over the end of the first outer conductor, the second member being made of a light transmitting material and including a metallic mesh within the material.

8. The fixture according to claim 1, wherein the high frequency ranges from 902 MHz to 928 MHz.

9. The fixture according to claim 8, wherein the frequency is 915 MHz.

10. The fixture according to claim 1 further including the conductors having an effective length substantially equal to one quarter wavelength long.

* * * * *

UNITED STATES PATENT OFFICE

CERTIFICATE OF CORRECTION

Patent No. 3,943,401 Dated March 9, 1976

Inventor(s) P. Haugsjaa/R. Regan/W. McNeill

It is certified that error appears in the above-identified patent and that said Letters Patent are hereby corrected as shown below:

Column 1, line 34, delete "Fehsenfield" and insert --Fehsenfeld--;

Column 1, line 37, after "cavity" (first occurrence) insert -- #--;

Column 4, line 54, after "conductor" insert --.--;

Column 6, line 42, delete "outer" and insert --inner--;

Signed and Sealed this

Sixth Day of July 1976

[SEAL]

*Attest:*

RUTH C. MASON
*Attesting Officer*

C. MARSHALL DANN
*Commissioner of Patents and Trademarks*